US007490736B2

(12) United States Patent
Moulton

(10) Patent No.: US 7,490,736 B2
(45) Date of Patent: Feb. 17, 2009

(54) POURING SPOUT

(75) Inventor: Alan Moulton, Sussex (GB)

(73) Assignee: SIG Combibloc International AG, Neuhausen am Rheinfall (CH)

( * ) Notice: Subject to any disclaimer, the term of this patent is extended or adjusted under 35 U.S.C. 154(b) by 242 days.

(21) Appl. No.: 10/492,768

(22) PCT Filed: Oct. 18, 2002

(86) PCT No.: PCT/EP02/11678

§ 371 (c)(1),
(2), (4) Date: Jun. 7, 2005

(87) PCT Pub. No.: WO03/035491

PCT Pub. Date: May 1, 2003

(65) Prior Publication Data

US 2005/0252931 A1 Nov. 17, 2005

(30) Foreign Application Priority Data

Oct. 20, 2001 (GB) ..... 0125296.4

(51) Int. Cl.
*B67D 5/00* (2006.01)

(52) U.S. Cl. ..... 222/83; 220/258.4

(58) Field of Classification Search ..... 222/80–92, 222/556, 541.2, 566, 541.6; 220/258.4, 247, 220/277, 278, 705, 711–713
See application file for complete search history.

(56) References Cited

U.S. PATENT DOCUMENTS

| | | | | |
|---|---|---|---|---|
| 4,779,764 | A * | 10/1988 | Debetencourt | 222/83 |
| 5,020,690 | A * | 6/1991 | Kishikawa et al. | 222/83 |
| 5,141,133 | A * | 8/1992 | Ninomiya et al. | 222/83 |
| 6,745,923 | B2 * | 6/2004 | Julian | 222/541.6 |
| 6,820,764 | B2 * | 11/2004 | Miani et al. | 222/83 |

FOREIGN PATENT DOCUMENTS

| | | |
|---|---|---|
| EP | 1 127 798 A1 | 2/2000 |
| WO | WO 98/41452 | 9/1998 |
| WO | WO 99/62775 | 12/1999 |
| WO | WO 01/60705 A2 | 1/2001 |

* cited by examiner

*Primary Examiner*—Lien T Ngo
(74) *Attorney, Agent, or Firm*—The Webb Law Firm

(57) ABSTRACT

The invention describes a pouring spout device, comprising a reclosable closure, and a spout fitment having a planar base and a tubular side wall defining a pouring zone therein and a flap disposed at a lower end of the side wall, a cam follower extending upward from said flap, wherein the closure retained on said fitment has an end wall and a tubular side wall, wherein the end wall has a first cam depending therefrom and engageable with said cam follower, and wherein the first cam contacting the cam follower during rotation of the closure. To avoid breakage of the cam follower, when the reclosable closure is replaced on the spout fitment, a second cam is formed on the reclosable closure and disposed radially outermost of the first cam. When the cam follower reaches the end region, it can move radially inwardly returning to the surface of the first cam.

15 Claims, 4 Drawing Sheets

POURING SPOUT

BACKGROUND OF THE INVENTION

1. Field of the Invention

The present invention relates to a feature of a pouring spout device for packaging and in particular to a cam feature for an automatic opening feature of a pouring spout device for a liquid carrying package.

2. Description of Related Art

Pouring spout devices that have an automatic opening feature may be used for packages and containers for pourable food products. These types of pouring spout devices comprise a reclosable cap and a spout fitment affixed to the package. The automatic opening feature comprises a cam feature formed an the inside of the reclosable cap and a hinged flap formed with a cam follower. The hinged flap is disposed within the spout fitment. The pouring device may be attached to the outer surface of the package adjacent to a weakened area of the package or adjacent to a film sealing a hole in the package. Such pouring spout devices are disclosed in the published PCT application no. WO 98/41452 and the published PCT application no. WO 99/62775.

Another prior art document that describes a similar type of pouring spout device with an automatic opening feature is published European patent application no. EP 1127798, in the name of Rexam Medical Packaging Inc. In this document a spout fitment comprises a cam follower that has a triangular shape and extends upward from a hinged flap. A spiral cam extends from the inner surface of a reclosable cap. Upon opening of the cap the cam follower slides along the spiral cam so causing the flap to rotate downwardly about the hinge.

SUMMARY OF THE INVENTION

We have found that with some pouring spout devices that have an automatic opening feature when the closure is replaced onto the spout fitment the cam follower can become disposed radially outer of the cam feature thus making the automatic opening feature substantially inoperative. The radial displacement of the cam follower can potentially lead to breakage, whereby the cam follower is snapped off the spout fitment.

According to a first aspect of the present invention there is provided an automatic opening feature for a pouring spout device comprising a spout fitment and reclosable closure: the automatic opening feature comprising a first cam formed on the reclosable closure, a cam follower formed on the spout fitment, and a second cam formed on the reclosable closure and disposed radially outer of the first cam.

In use if the cam follower becomes disposed radially outer of the first cam, the second cam provides means by which the cam follower is brought back to the correct operative relationship with the first cam.

The second cam is preferably substantially adjacent the first cam.

The first cam is preferably a spiral cam.

The second cam is preferably a curved cam.

The first cam and the second cam preferably comprise a common end region.

The reclosable closure comprises a tubular wall enclosed at one end by an end wall and preferably the first cam extends from the common end region in a direction away from the end wall and the second cam extends from the common end region in a direction towards the end wall.

Preferably, the common end region is distant from the end wall of the reclosable closure.

In a preferred arrangement of the present invention the first cam and the second cam extend from the common end region in a common direction, the arrangement being such that a cam surface of the first cam ascends away from the end wall and a cam surface of the second cam descends towards the end wall.

According to a second aspect of the present invention there is provided a pouring spout device comprising a reclosable closure for an automatic opening feature according to the first aspect of the present invention.

According to a third aspect of the present invention there is provided a reclosable closure for an automatic opening feature according to the first aspect of the present invention.

The present invention may include any combination of the features or limitations referred to herein.

The present invention may be carried into practice in various ways, but an embodiment will now be described by way of example only with reference to the accompanying drawings in which:

DESCRIPTION OF THE PREFERRED EMBODIMENTS

Figure 1:
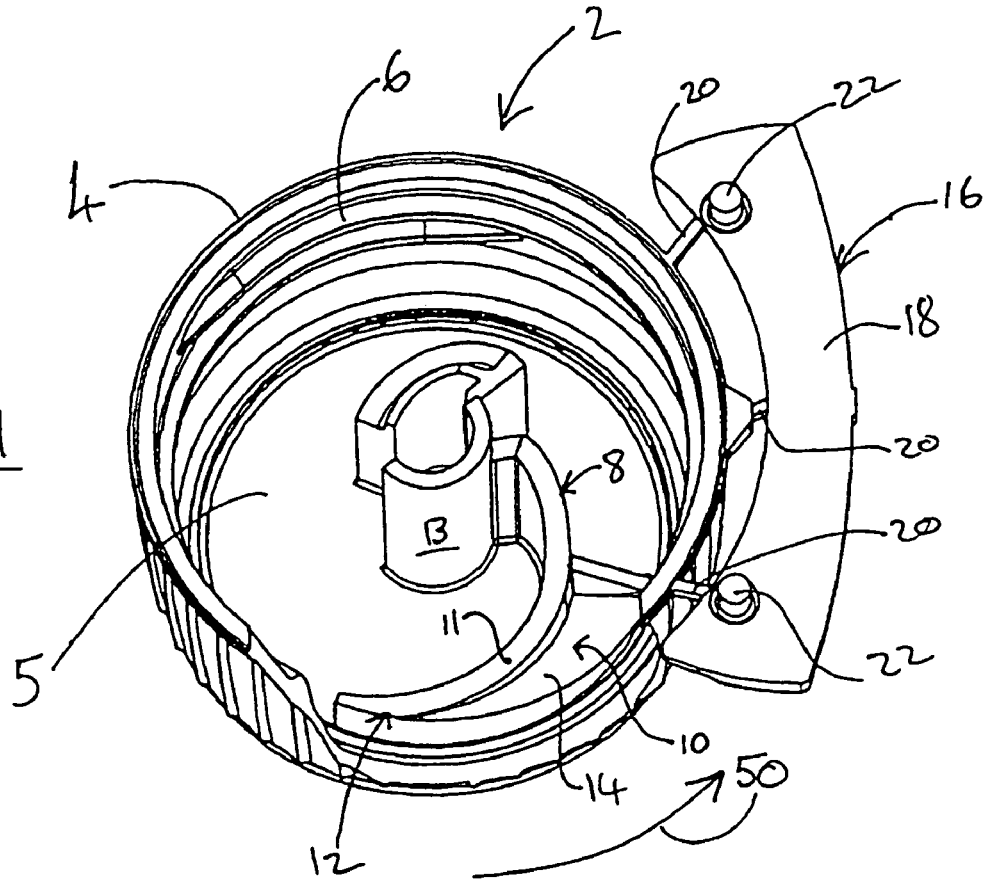
FIG. 1 is a first isometric view of a reclosable closure and shows a part cut away region.
Figure 2:
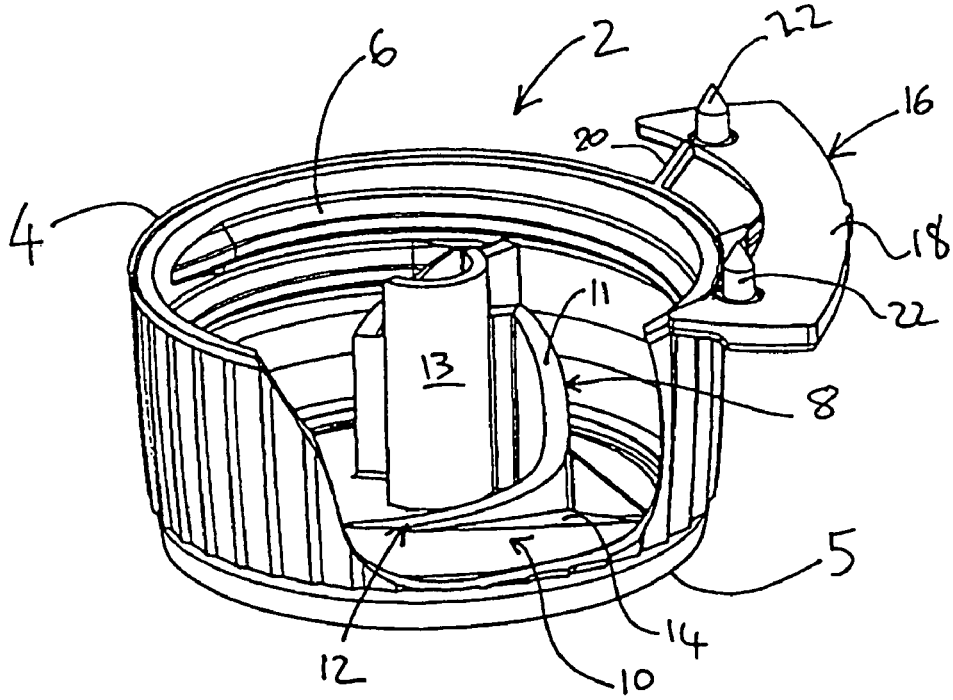
FIG. 2 is a second isometric view of the reclosable closure shown in FIG. 1.
Figure 3:
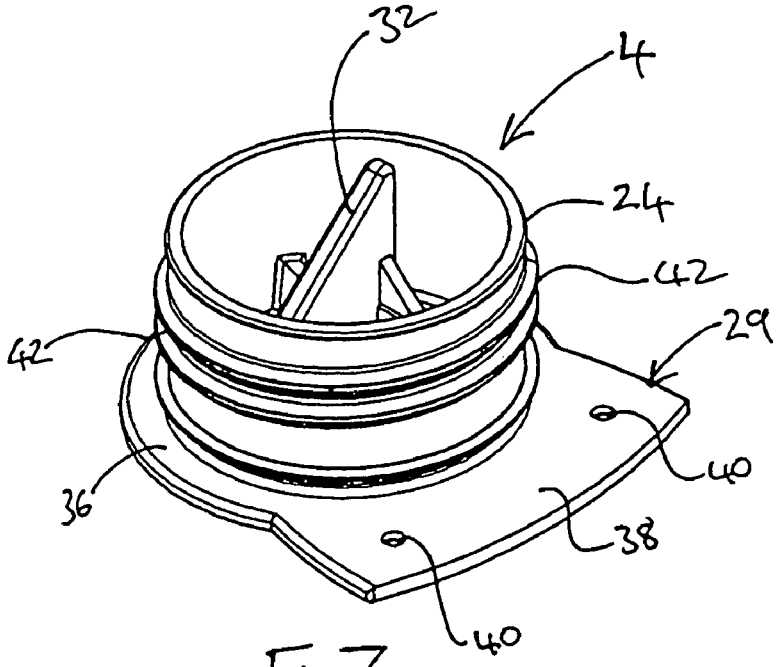
FIG. 3 is an isometric view of the top of a spout fitment.
Figure 4:
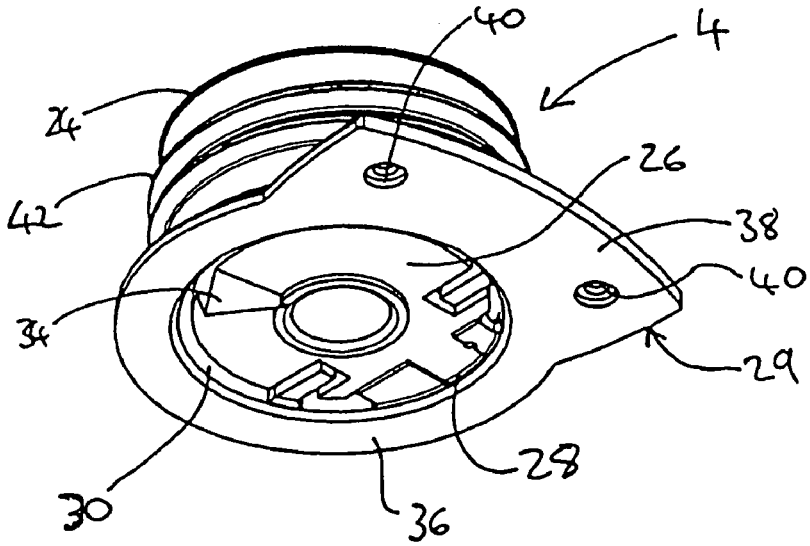
FIG. 4 is an isometric view of the bottom of the spout fitment shown in FIG. 3.
Figure 5:
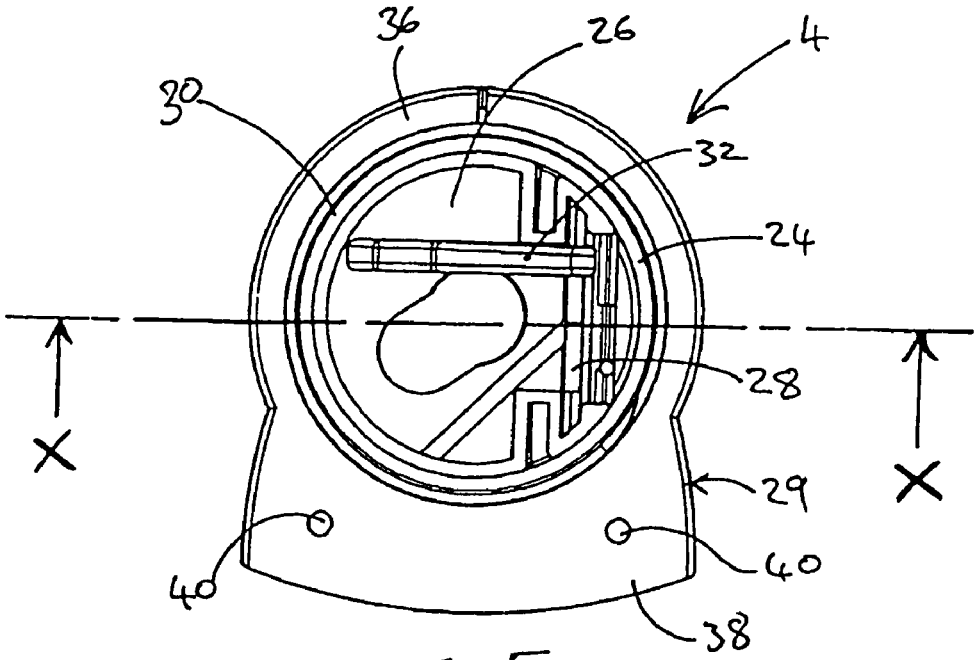
FIG. 5 is a plan view of the spout fitment shown in FIGS. 3 and 4.
Figure 6:
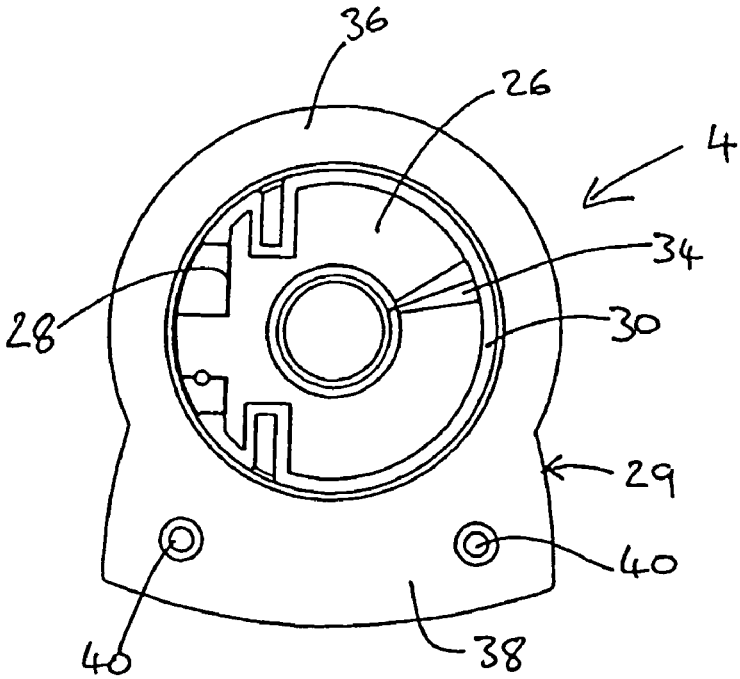
FIG. 6 is a bottom view of the spout fitment shown in FIGS. 3 to 5.
Figure 7:
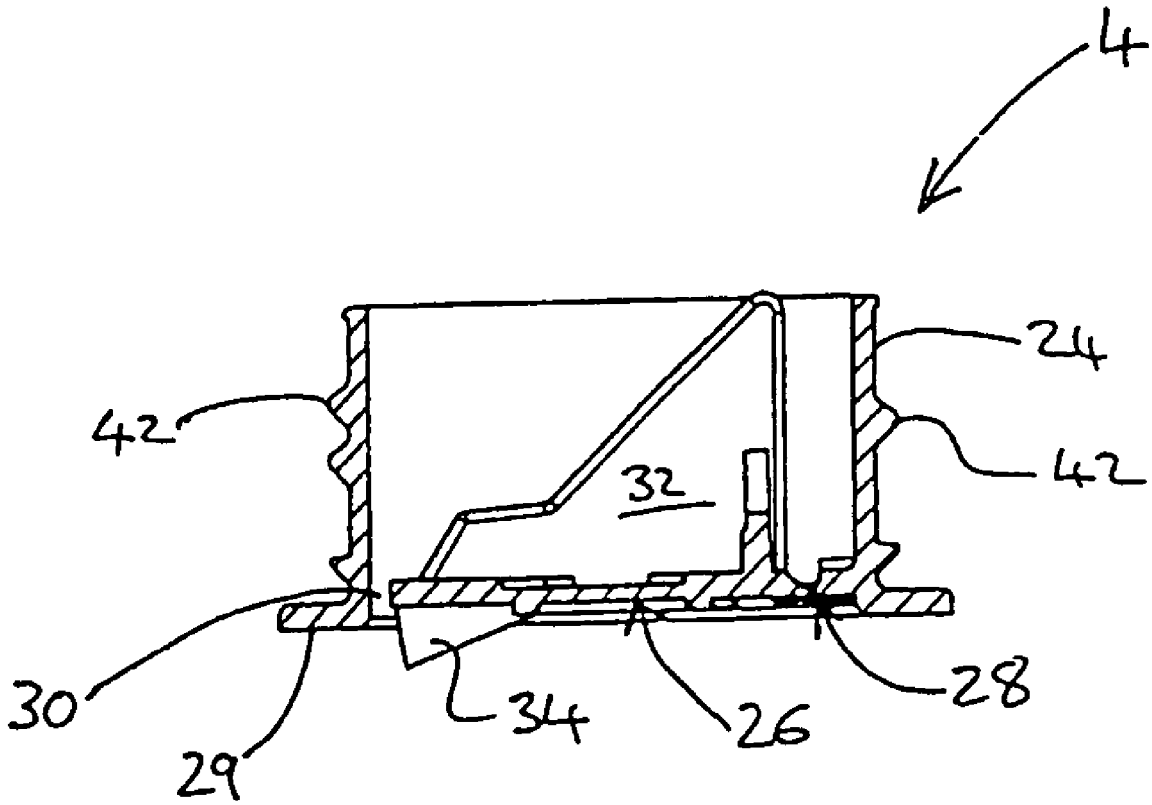
FIG. 7 is a cross section view through X-X shown in FIG. 5.

Referring to the Figures, a pouring spout device comprises a reclosable closure 2 (shown in FIGS. 1 and 2) and a spout fitment 4 (shown in FIGS. 3 to 7).

The closure 2 comprises a tubular side wall 3 that is enclosed at one end by an end wall 5. The tubular side wall 3 is shown partially cut away to improve the view of the inner elements of the closure 2. The side wall 3 is formed with an internal thread 6. There is a first cam 8 formed an the inner surface of the end wall 5 and a second cam 10 disposed radially outermost of the first cam 8.

The first cam 8 is a spiral shape and comprises a sloping cam surface 11 that extends from a end region 12 in an anticlockwise direction upwardly away from the end wall 5 towards a central arcuate pillar 13. The second cam 10 comprises a sloping cam surface 11 that extends from the end region 12 in an anticlockwise direction downwardly towards the end wall 5.

A tamper evident element 16 comprises an arcuate section 18 frangibly attached to the side wall 3 by three nibs 20. The arcuate section 18 is formed with two spikes 22.

The spout fitment 4 comprises a planar base 29, a tubular side wall 24 and a disc-shaped flap section 26 disposed at a lower end of the side wall 24 and attached thereto by a hinge 28. An arcuate gap 30 separates a substantial part of the flap 26 from the side wall 24 so allowing the flap 26 to pivot about the hinge 28. A triangular cam follower 32 extends from the upper surface of the flap 26 and a cutting part 34 extends from the lower surface of the flap 26. The base 29 comprises an annular portion 36 that extends partially around the lower end of the side wall 24 and a flange portion 38 formed with two holes 40 adapted to receive the spikes 22 of the tamper evident element 16. The tubular side wall 24 is formed with an external thread 42 adapted to correspond with the internal thread 6 of the closure 2.

In use the base 29 of the spout fitment 4 is attached to a container, the flap 26 being disposed adjacent a weakened region of the container. The reclosable closure 2 is placed onto the spout fitment 4 and the spikes 22 are received by and held within the holes 40. In the closed state the upper portion of the cam follower 32 is disposed at the end region 12. When the closure 2 is unscrewed from the spout fitment 4 for the first time the frangible nibs 20 are broken so leaving the arcuate section 18 still attached to the flange portion 38. As the closure 2 is unscrewed from the spout fitment 4 the cam follower 32 travels along the cam surface 11 of the first cam 8 in a direction 50. As the cam follower travels along the cam surface 11 the flap 26 is rotated about the hinge 28 due to the steep incline of the cam surface 11 and the incline of the cam follower 32. As the flap 26 rotates the cutting part 34 is forced through the weakened region of the container. This method of piercing a container is known to the skilled person in the art and is described in the published European patent application no. EP 1127798.

In some circumstances the cam follower 32 may come off the cam surface 11 and become disposed radially outwardly of the cam surface 11. If the cam follower 32 remains like this the cam follower 32 and the flap 26 are not pivoted about the hinge 28 when the closure 2 is unscrewed from the spout fitment 4. Hence, the pouring spout device would be substantially inoperative and the cam follower 32 may be snapped off the spout fitment 4.

The second cam 10 of the present invention provides a means by which the cam follower 32 may be placed back onto the cam surface 11 of the first cam B. If the cam follower 32 has become disposed radially outwardly of the cam surface 11 then the end portion of cam follower 32 will come into contact with the cam surface 14 of the second cam 10 an rotation of the closure 2 in the opposite direction to direction 50. On further rotation of the closure 2 in the opposite direction to direction 50 the cam follower 32 will travel across the cam surface 14 towards the end region 12. When the cam follower 32 reaches the end region 12 the cam follower 32 will be able to move radially inwardly and return to the cam surface 11 of the first cam 8. The cam follower 32 will then be correctly positioned for future opening operations.

It will be appreciated that the orientation of the first cam and second cam will depend upon the type of thread used i.e. whether a left hand thread or right hand thread is used.

The invention claimed is:

1. A pouring device, comprising: a spout fitment and a reclosable closure, the spout fitment having a planar base and a tubular side wall defining a pouring zone therein and a flap disposed at a lower end of the side wall, a cam follower extending upward from the flap, wherein the closure retained on said fitment has an end wall and a tubular side wall, wherein the end wall has a central pillar and a first cam depending therefrom and engageable with the cam follower, said first cam having a spiral shape with a sloping surface extending from it's end region upwardly anticlockwise from the end wall towards the central pillar and wherein the first cam contacting the cam follower during rotation of the closure, and a second cam formed on the reclosable closure and disposed radially outermost of the first cam, said second cam extends from the end region of the first cam in the same direction as the first cam downwardly toward the end wall to direct the cam follower radially inward and back into engagement with the first cam.

2. A pouring device, comprising: a spout fitment and a reclosable closure, the spout fitment having a planar base and a tubular side wall defining a pouring zone therein and a flap disposed at a lower end of the side wall, a cam follower extending upward from the flap, wherein the closure retained on said fitment has an end wall and a tubular side wall, wherein the end wall has a first cam depending therefrom and engageable with the cam follower, said first cam having a spiral shape with a sloping surface extending from it's end region upwardly anticlockwise from the end wall and wherein the first cam contacting the cam follower during rotation of the closure, and a second cam formed on the reclosable closure and disposed radially outermost of the first cam, said second cam extends from the end region of the first cam in the same direction as the first cam downwardly toward the end wall to direct the cam follower radially inward and back into engagement with the first cam wherein the second cam is substantially adjacent the first cam.

3. The pouring spout device according to claim 1, wherein the first cam decreases in height from a central arcuate pillar.

4. The pouring spout device according to claim 1, wherein the second cam is a curved cam.

5. The pouring spout device according to claim 1, wherein the first cam and the second cam comprise a common end region.

6. The pouring spout device according to claim 5, wherein the common end region is not adjacent the end wall of the reclosable closure.

7. The pouring spout device according to claim 1, wherein the flap has a hinge extending along a segment thereof and wherein the flap is bounded by an arcuate gap in between the flap and the side wall, wherein the gap allows the flap to rotate about the hinge.

8. The pouring spout device according to claim 1, wherein the cam follower on the flap is triangular in shape.

9. The pouring spout device according to claim 8, wherein the cam follower is formed on the flap perpendicular to the hinge.

10. The pouring spout device according to claim 8, wherein the cam follower extends from the upper surface of the flap.

11. The pouring spout device according to claim 8, wherein a cutting part extends from the lower surface of the flap.

12. The pouring spout device according to claim 1, wherein a tamper evident element with an arcuate section frangibly connected to the side wall of the closure.

13. The pouring spout device according to claim 12, wherein the tamper evident element is attached to the side wall of the closure by at least one nib.

14. The pouring spout device according to claim 1, wherein the spout fitment has an automatic opening feature.

15. The pouring spout device of claim 1, comprising a reclosable closure with an automatic opening feature.

* * * * *